US011232678B2

(12) United States Patent
Berman et al.

(10) Patent No.: US 11,232,678 B2
(45) **Date of Patent: *Jan. 25, 2022**

(54) SYSTEMS, APPARATUSES AND METHODS FOR FACILITATING ENHANCEMENT OF GAMING PAYOUT MODIFIERS

(71) Applicant: KING SHOW GAMES, INC., Minnetonka, MN (US)

(72) Inventors: Bradley Berman, Minnetonka, MN (US); Jacob Lamb, Maple Grove, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/015,034

(22) Filed: Sep. 8, 2020

(65) Prior Publication Data

US 2020/0402365 A1 Dec. 24, 2020

Related U.S. Application Data

(63) Continuation of application No. 15/798,683, filed on Oct. 31, 2017, now Pat. No. 10,769,891.

(60) Provisional application No. 62/419,414, filed on Nov. 8, 2016.

(51) Int. Cl.
*G07F 17/32* (2006.01)
*G07F 17/34* (2006.01)

(52) U.S. Cl.
CPC ..... *G07F 17/3262* (2013.01); *G07F 17/3209* (2013.01); *G07F 17/3213* (2013.01); *G07F 17/3225* (2013.01); *G07F 17/3241* (2013.01); *G07F 17/3244* (2013.01); *G07F 17/34* (2013.01)

(58) Field of Classification Search
USPC ..... 463/20, 22
See application file for complete search history.

(56) References Cited

U.S. PATENT DOCUMENTS

| | | | | |
|---|---|---|---|---|
| 6,004,207 | A | 12/1999 | Wilson, Jr. et al. | |
| 6,315,660 | B1 | 11/2001 | Demar et al. | |
| 8,992,323 | B2 * | 3/2015 | Kelly | G07F 17/3211 463/37 |
| 10,607,443 | B2 * | 3/2020 | Berman | G07F 17/3213 |
| 10,916,097 | B2 * | 2/2021 | Wodarz | G07F 17/3262 |
| 2004/0038731 | A1 | 2/2004 | Englman | |
| 2004/0142740 | A1 | 7/2004 | Damico et al. | |
| 2009/0061982 | A1 | 3/2009 | Brito | |
| 2009/0111557 | A1 | 4/2009 | Jankowski | |
| 2009/0325688 | A1 | 12/2009 | Naicker | |
| 2010/0124973 | A1 | 5/2010 | DeWaal et al. | |
| 2011/0045898 | A1 | 2/2011 | Anderson | |
| 2011/0111845 | A1 | 5/2011 | Fitzsimons et al. | |
| 2011/0124402 | A1 | 5/2011 | Waal et al. | |
| 2012/0122532 | A1 | 5/2012 | Berman et al. | |
| 2012/0258783 | A1 | 10/2012 | Chan et al. | |

(Continued)

*Primary Examiner* — Pierre E Elisca

(57) ABSTRACT

Systems, apparatuses and methods for enhancing gaming awards in gaming activities. At least one payout modifier is awarded, and its use is deferred. During the deferment period, the payout modifier is allowed to increase to create an increased payout modifier. An end of the deferral period is randomly determined, and the increased payout modifier is awarded for use in the gaming activity. Embodiments further provide the player an option to keep the originally awarded payout modifier, or to surrender it to allow it to be deferred with potential growth.

20 Claims, 12 Drawing Sheets

(56) References Cited

U.S. PATENT DOCUMENTS

| | | | | |
|---|---|---|---|---|
| 2013/0130770 | A1 | 5/2013 | Oles et al. | |
| 2013/0217491 | A1* | 8/2013 | Hilbert | G07F 17/322 463/31 |
| 2014/0031099 | A1 | 1/2014 | Williams | |
| 2014/0094256 | A1* | 4/2014 | Hilbert | G07F 17/3211 463/20 |
| 2014/0094298 | A1* | 4/2014 | Lyons | G07F 17/322 463/31 |
| 2014/0113703 | A1 | 4/2014 | Bigelow, Jr. et al. | |
| 2018/0130296 | A1* | 5/2018 | Berman | G07F 17/3209 |
| 2018/0130305 | A1 | 5/2018 | Berman et al. | |
| 2018/0130307 | A1* | 5/2018 | Lamb | G07F 17/3265 |
| 2019/0164387 | A1* | 5/2019 | Dobrosevic | G07F 17/3258 |

* cited by examiner

SYSTEMS, APPARATUSES AND METHODS FOR FACILITATING ENHANCEMENT OF GAMING PAYOUT MODIFIERS

RELATED APPLICATIONS

This application is a continuation of U.S. application Ser. No. 15/798,683, filed Oct. 31, 2017, now U.S. Pat. No. 10,769,891, which claims the benefit of Provisional Patent Application No. 62/419,414, filed on Nov. 8, 2016, to which priority is claimed pursuant to 35 U.S.C. § 119(e) and which is incorporated herein by reference in its entirety.

FIELD

This disclosure relates generally to games, and more particularly to systems, apparatuses and methods for enhancing payout modifiers during their deferred use, and awarding the enhanced payout modifiers for use in continued game play.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and provide advantages over the prior art.

SUMMARY

The present disclosure is directed to systems, apparatuses, computer-readable media, and/or methods that are configured to award payout modifiers, and enable deferral of their use. During this deferment of use, the payout modifier may be allowed to increase. When the deferral period is randomly determined to end, the increased payout modifier is awarded for use in the gaming activity. Some embodiments allow the player to choose to keep the originally awarded payout modifier, or to surrender it to allow it to be deferred with potential growth.

In accordance with one embodiment, a slot game apparatus is provided for enhancing gaming awards in a gaming activity including a series of gaming events. The slot game apparatus includes a display, a user interface, a wager input device, and a processor. The display presents symbol locations that form a symbol array. The user interface includes at least one user input to enable a player to initiate a slot game event presented via the symbol array. The wager input device is structured to identify and validate player assets, and to permit the player to play the slot game event when the player assets are provided. The processor is configured with software to create operational modules to randomly award a payout modifier, and facilitate player choice of accepting the payout modifier for current use or suspending use of the payout modifier for later use. The processor is further configured to determine the player's response, and in response to the player choice to suspend use of the payout modifier for later use, to suspend use of the payout modifier and allow the payout modifier to randomly increase. The processor is further configured to randomly activate the payout modifier to be applied to a payout to create a modifier-enhanced payout.

In one embodiment of such a slot game apparatus, the processor is configured to allow the payout modifier to randomly increase by causing the payout modifier to increase at least some amount to create an increased modifier, and to randomly activating the payout modifier by randomly activating the increased modifier to be applied to the payout to create the modifier-enhanced payout. In various embodiments, the processor is configured to cause the payout modifier to increase at random times, and/or by random amounts, while the use of the payout modifier is suspended. In another embodiment, the processor is configured to cause the payout modifier to increase each time another of the gaming events is played and while the use of the payout modifier is suspended. The processor may be configured to cause the payout modifier to increase each gaming event or over time, increase sometimes, decrease sometimes, remain the same sometimes, increase generally over time while allowing some decreases and/or no change, and/or any other scheme deemed appropriate for the game and rules desired.

Another embodiment of such a slot game apparatus involves the configured processor enabling the payout modifier to remain at a same value without increasing in value. Thus, some embodiments may always cause one or more of the suspended multipliers to increase in value, while other embodiments may enable the value to increase or to stay the same (and still in other embodiments to decrease).

The processor is configured, in one embodiment, to prohibit use of the payout modifier while the payout modifier is suspended, and to randomly activate the payout modifier to be applied to the next payout occurring in connection with the gaming events, where in other embodiments the payout modifier is applied to the next gaming activity's payout, if any.

In other embodiments, the processor is configured to suspend the use of the payout modifier and allow the payout modifier to randomly increase for a random number of the gaming events, while in other embodiments to randomly increase for a number of the gaming events within a predetermined range of the gaming events.

Another embodiment involves the configured processor randomly awarding the payout modifier before a result of one of the gaming events to which the player could accept the payout modifier for current use. In an alternative embodiment, the payout modifier is awarded after the result of one of the gaming events to which the player could accept the payout modifier for current use.

In another embodiment, the processor is configured to randomly award multiple payout modifiers, and randomly activate one or more the payout modifiers to be applied to the payout. Another embodiment involves concurrently activating multiple payout modifiers, and creating a new payout modifier using a mathematical association of the plurality of the payout modifiers.

In some embodiments, the processor applies the increased modifier by enabling the player to choose which gaming result or payout to apply the increased modifier. In yet other embodiments, use of the payout modifier is enabled in response to a player's election to use the payout modifier for an immediately succeeding one of the gaming events.

Another embodiment involves a slot game apparatus for enhancing gaming awards in a gaming activity that includes a series of gaming events. The slot game apparatus includes a display, a user interface, a wager input device, and a processor. The display presents symbol locations that form a symbol array. The user interface includes at least one user input to enable a player to initiate a slot game event presented via the symbol array. The wager input device is structured to identify and validate player assets, and to permit the player to play the slot game event when the player assets are provided. The processor is configured with software to create operational modules to randomly award a payout modifier, postpone use of the payout modifier, randomly increase a value of the payout modifier during the postponed use of the payout modifier to create an increased payout modifier, randomly determine an end of the postponed use and the random increase in value of the payout modifier, and in response, award the increased payout modifier for use in at least one of the gaming events.

Some embodiments involve configuring the processor to award the increased payout modifier for use in the next gaming event, while other embodiments involve configuring the processor to award the increased payout modifier for use in the next gaming event that has a winning payout.

Another variation of such a slot game apparatus involves awarding multiple payout modifiers, any number of which may be concurrently awarded, concurrently postponed and potentially increasing, and concurrently activated for use. In one particular embodiment, the processor awards at least a second payout modifier during the postponed use of the first payout modifier, where both the first and second payout modifiers are postponed for use. The values of the first and second payout modifiers may be randomly increased during the postponed use of both the first and second payout modifiers. The processor randomly determines an end of the postponed use and the random increase in value of each of the first and second payout modifiers to respectively create an increased first payout modifier and an increased second payout modifier. The increased first payout modifier is awarded for use in response to determining the end of the postponed use of the first payout modifier, and the increased second payout modifier is awarded for use in response to determining the end of the postponed use of the second payout modifier.

In other embodiments of such a slot game apparatus, the processor is configured to facilitate player choice of accepting the payout modifier for current use, or to postpone use of the payout modifier for later use.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter.

DETAILED DESCRIPTION

Figure 1:
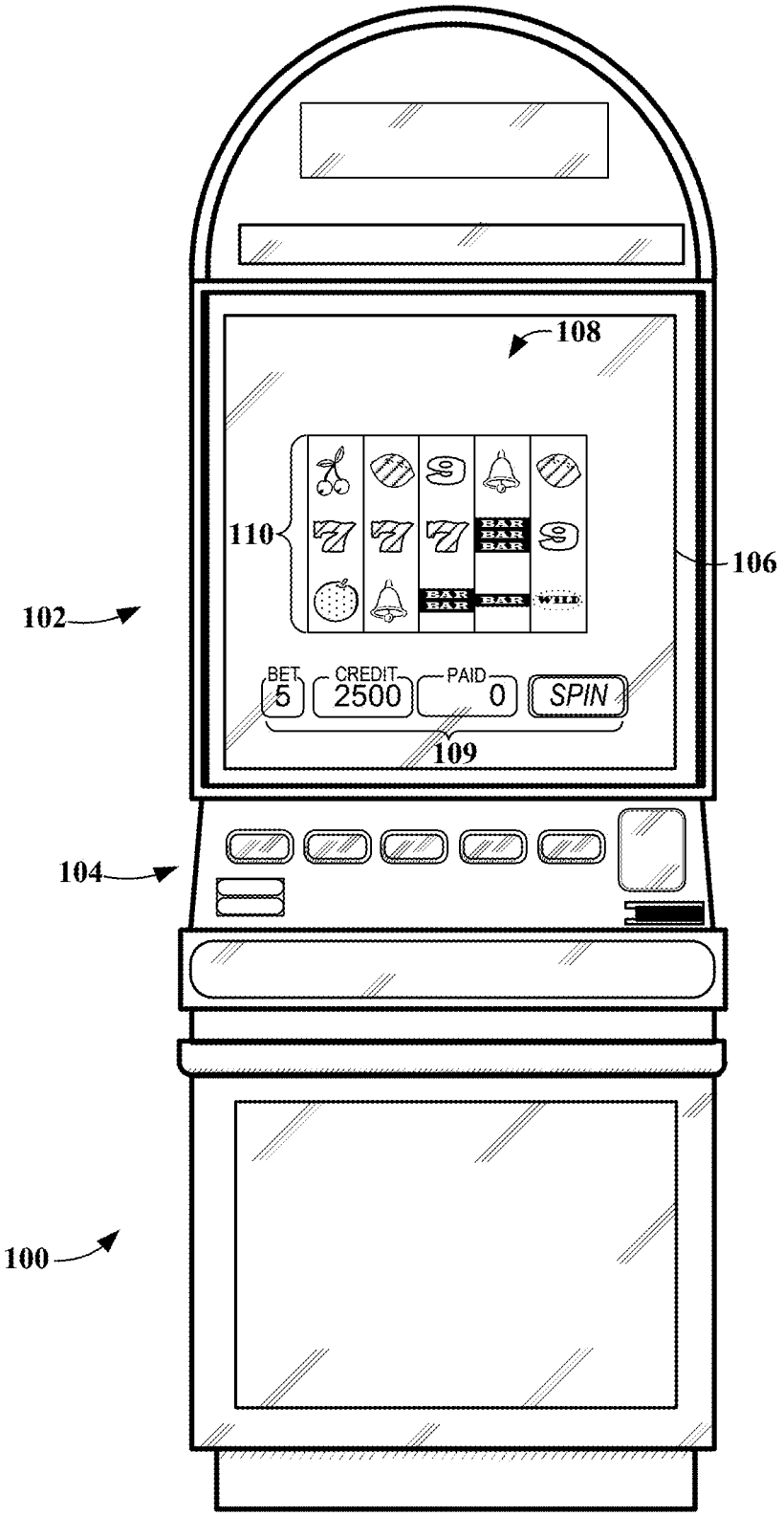
FIG. 1 is a diagram of a representative gaming machine capable of facilitating player use and interaction with games and features in accordance with the invention and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for facilitating risk-based player decisions relating to payout enhancements in gaming activities. A payout modifier(s) may be triggered or randomly presented during play of a gaming activity. For example, discrete gaming events or other game segments may form part of an overall gaming activity, and in connection with some game events/segments a payout modifier(s) may be awarded randomly, based on some triggering event, etc. The player is provided an opportunity to choose from at least the options of utilizing the modifier on a current gaming event, or suspending its use until some future gaming event. There is therefore an option to delay use of an award modifier, potentially with some risk as to how it might get applied when it is later available to be applied to a subsequent payout.

For example, in one slot game embodiment, the player is afforded an opportunity to choose to keep an awarded multiplier(s) (and/or other payout modifier) to apply to a particular reel spin event, or to risk it with the chance that it will provide an even more favorable total payout result later by choosing not to apply the awarded multiplier to a present event but rather to put it aside and allow it to grow some amount to apply to a subsequent reel spin result and/or reel spin win. Thus, in one embodiment, a multiplier or other modifier is awarded, and the player chooses to let it grow for a limited number of future plays, at the risk of getting a lower payout amount (or in some embodiments no payout amount) in which to apply the larger multiplier. Various embodiments therefore facilitate a player trade-off, where the player can choose to use the modifier(s) under known circumstances, or risk it by forfeiting the available and known current result in favor of subsequently applying an increased modifier(s) to an unknown payout result.

The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that facilitates a player's optional delay in using an award modifier, such as in an effort to have a potentially increased award modifier apply to a different payout in a later gaming event.

Numerous variations are possible in view of these and other embodiments of the inventive concept. Representative embodiments and variations are described herein, with some embodiments described with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, roulette, bingo, or other games of chance. Some of these other types of embodiments will be discussed below as variations to the examples illustrated. However, many other types of games can implement similar techniques and fall within the scope of this disclosed concept.

Referring to the example gaming apparatus 100 shown in FIG. 1, the representative gaming apparatus includes at least a display area(s) 102 (also referred to as a gaming display), and a player interface area(s) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaming portion 108 may render graphical objects such as cards, slot reels, dice, animated characters, and any other gaming visual known in the art. The primary gaming portion 108 may also inform players of the outcome of any particular event, including whether the event resulted in a win or loss.

In some example embodiments illustrated herein, the primary gaming portion 108 may display a grid (or equivalent arrangement) of game elements 110 or game element positions (also referred to herein as "reel stop positions"). As illustrated in the embodiment shown in FIG. 1, the grid includes three rows and five columns of game elements 110, which may form a game outcome(s) of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as pay tables, navigation controls, etc.

Figure 2:
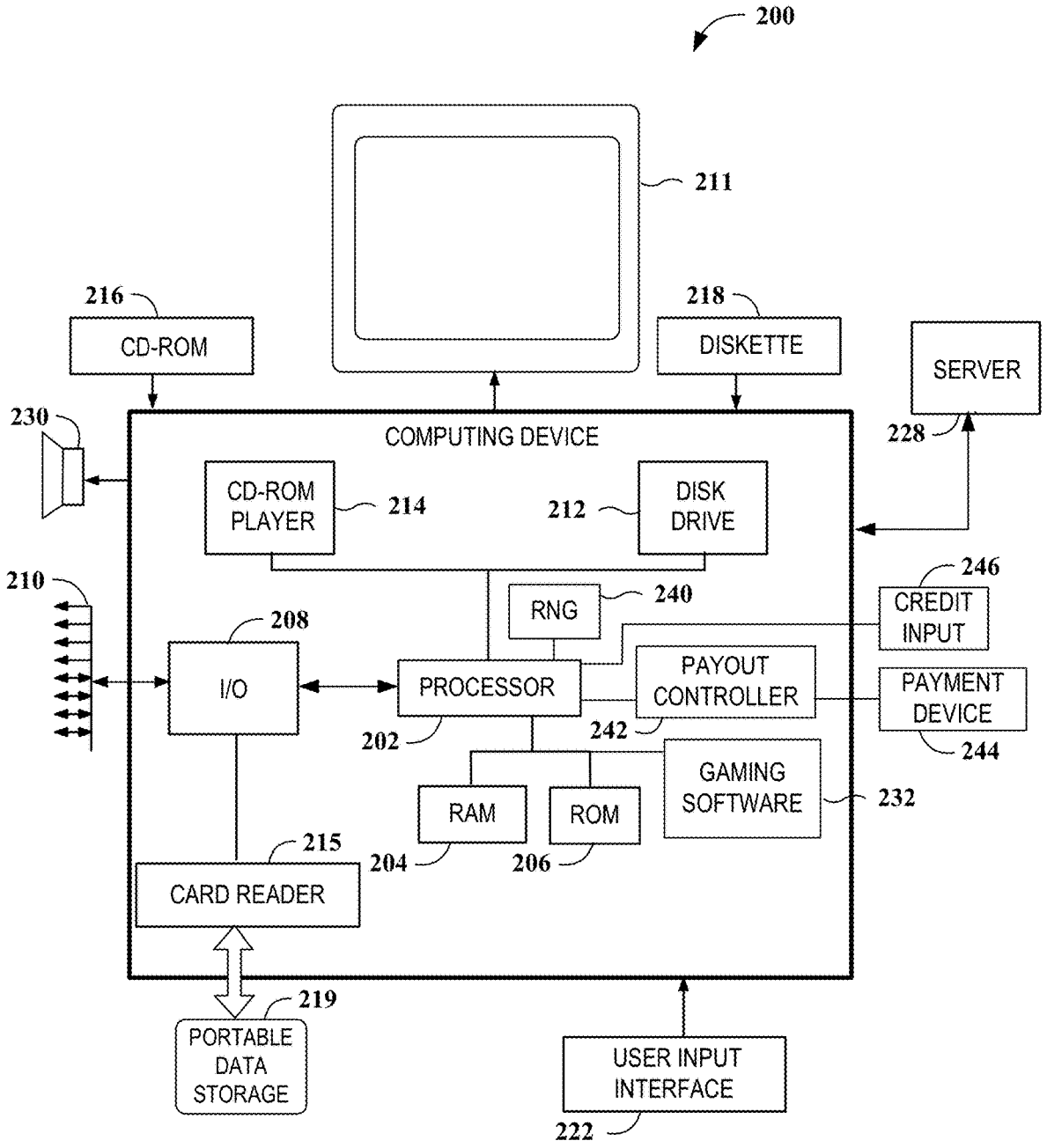
FIG. 2 is a block diagram illustrating a representative computing arrangement capable of implementing games and features in accordance with the invention and representative embodiments described herein.

Although FIG. 1 illustrates a particular implementation of some of the embodiments of this invention in a casino or electronic gaming machine ("EGM"), one or more devices may be programmed to play various embodiments of the invention. The concepts and embodiments described herein may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of the invention.

The example computing arrangement 200 suitable for performing the gaming functions described herein includes a processor, such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM or any technology capable of storing data). The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to one or more displays 211, which represent a manner in which the gaming activities may be presented. The display 211 represents the "presentation" of the game information in accordance with the disclosure, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server(s) 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, or any other player assets, for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

The systems, apparatuses and methods operable via these and analogous computing and gaming devices can support gaming features as described herein. In one embodiment, a payout modifier(s), such as a multiplier, is awarded. The payout modifier is set aside for later use rather than current use, which may be a result of, for example, a player choosing to use it later versus presently, or due to game configuration where it happens automatically. While the modifier(s) is set aside and unavailable for use, it may increase in value. Cessation of this suspension period is randomly determined, and the increased payout modifier is awarded for use in the gaming activity, such as to increase a gaming payout.

Many embodiments may be described in terms of a slot game, where symbols are matched on, for example, paylines and/or quantity to determine payout awards. However, the principles described herein are equally applicable to other games of chance, as described herein and as will be readily apparent to those skilled in the art from the teachings herein. For example, in a slot game embodiment, a representative method of operating a gaming device includes providing a player a choice to use a multiplier or other modifier(s) on a spin where it was awarded or otherwise targeted, or to save it for use on a subsequent game outcome(s). In other embodiments, all awarded multipliers may be automatically saved for later use.

Figure 3:
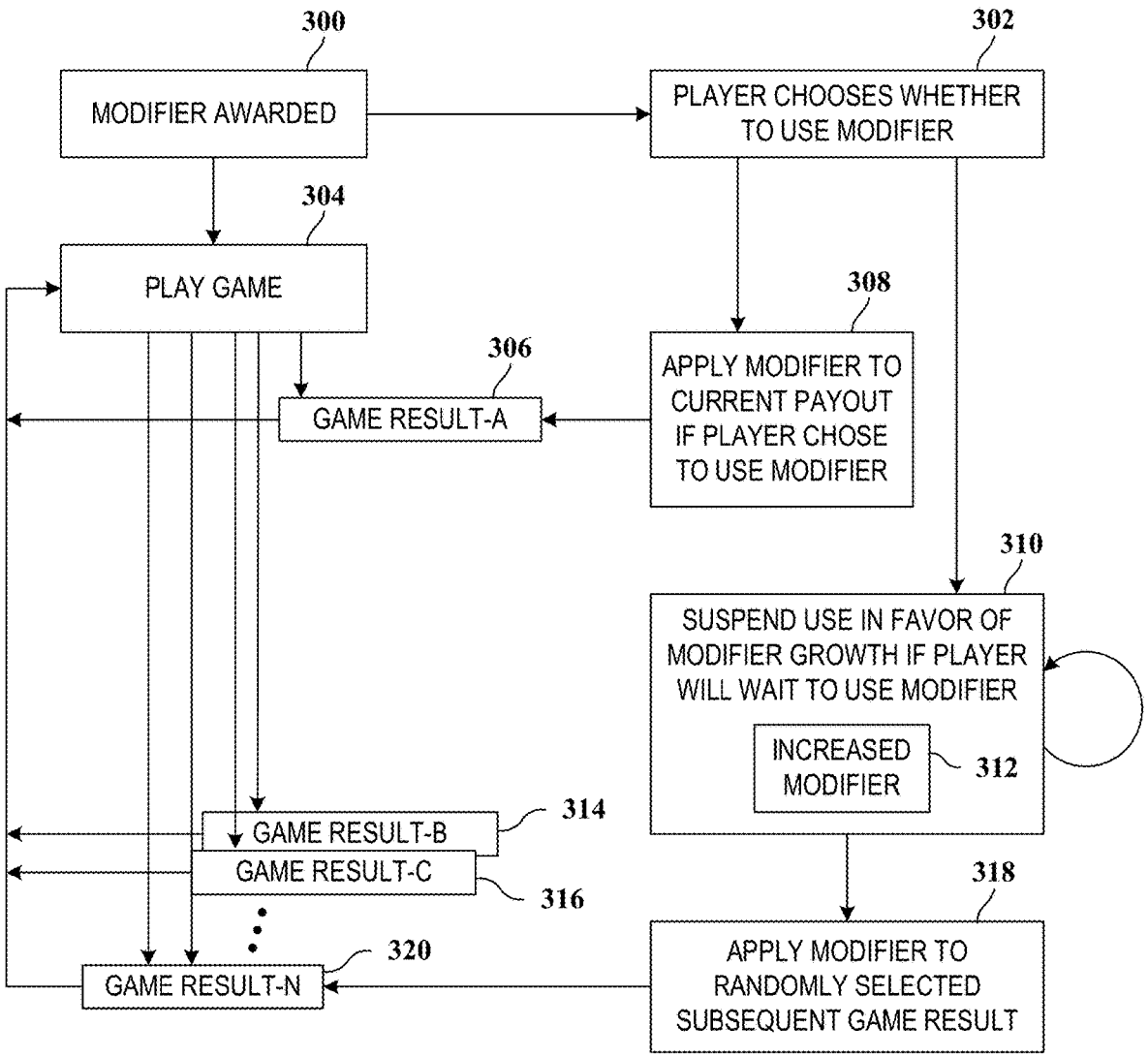
FIG. 3 depicts an embodiment for facilitating player selection and use of a potentially larger award modifier in lieu of a currently-available award modifier

FIG. 3 is a block diagram of an embodiment for facilitating player selection and use of a potentially larger award modifier in lieu of a known but smaller current award modifier. This embodiment may be applicable to any game of chance utilizing award modifiers or other award enhancements, including slot games, poker, bingo, keno, roulette, etc. While the present embodiment is described in terms of a postponed use of a modifier that increases in value during the postponement, other embodiments involve the player choosing between utilizing a modifier that has the same value at the time of subsequent use as it does at the time of the decision and current use. Also, other embodiments may not involve the player choosing whether to use the modifier for a current award or a subsequent award, but rather may be automatically stored for subsequent use, whether the modifier remains the same value or whether it increases or decreases. However, in the example of FIG. 3, it is assumed that the player is afforded an opportunity to presently use the modifier or postpone its use, with postponement involving an increased modifier but without specific knowledge of the award value to which it will be applied.

In the embodiment of FIG. 3, a modifier is awarded 300. For example, in the context of a slot game, the modifier may be a multiplier, exponent, and/or other mathematical function that may be applied to a gaming payout. Such a modifier(s) may be awarded randomly (e.g., at any time), at or within certain time periods (e.g., at least every X seconds of play), in response to triggering events (e.g., symbols, sub-symbols, overlays, or other random events), when a particular symbol combination(s) occurs, etc. Any manner of awarding 300 a modifier may be used in connection with the principles described herein.

In one embodiment, the player chooses 302 whether to use the awarded modifier. For example, the player may be provided with a visual and/or audible request to make a selection to keep and use the awarded modifier with a current gaming payout, or to store or otherwise put the awarded modifier aside for use in connection with a subsequent gaming payout. Some embodiments may not provide the player with such a choice, but rather may choose on behalf of the player, or automatically defer use of the modifier, etc.

The game, or particular gaming event portion of that game, is played 304. In one embodiment, the player chooses 302 whether to use the modifier before the result of the played game 304 has provided a result. However, the player choice 302 may be made before any activity in the gaming event (e.g., before a slot game reel spin), during the gaming event (e.g., during a slot game reel spin), or after the gaming event (e.g., after the reels have stopped spinning and a corresponding payout is known). In the example of FIG. 3, it is assumed that the player chooses 30 to whether to use the awarded modifier before a result of the gaming event, such as before the game result-A 306 resulting from the game play 304.

In one embodiment, the player may choose 302 to apply 308 the awarded modifier to a current payout, to secure a result with the awarded modifier. For example, if the game play 304 already occurred and it is known to the player what payout is associated with game result-A 306, the player would know what the final modifier-adjusted payout would be, the player may not want to risk losing that modifier-adjusted payout and therefore chooses to keep and use the awarded modifier. In other embodiments, the player may not know the game result-A 306, whereby the decision to use or suspend use of the awarded modifier is more random. Where the player chooses to user the awarded modifier presently, a winning payout for game result-A 306 will be increased by the awarded modifier. For example, if game result-A 306 is 100 credits, and the awarded modifier was a 3× (three times) multiplier, the total payout for that gaming event would be 500 credits. In some embodiments, a modifier is awarded 300 when it is known that game result-A 306 will produce a monetary payout, while in other embodiments the modifier may be awarded 300 where it is then applied to the next game result-A 306 (which could have a payout value or a zero value), or applied to the next game result that has a non-zero, positive payout, etc. In one embodiment, the game result-A 306 represents the next result of the gaming activity that will occur next (e.g., the next slot game spin), or alternatively could represent the current gaming event (e.g., the slot game spin currently active/spinning), or the preceding completed gaming event (e.g., the slot game spin result that just occurred), etc. Game play 304 may then continue normally at the choice of the player.

Alternatively, the player may choose 302 not to presently use the modifier, but rather to suspend present use 310 of the modifier to instead wait to use the modifier until a later gaming event. In one embodiment, the modifier will increase to at least some extent during the time in which its use has been suspended 310. For example, the modifier may randomly increase with time, may periodically or otherwise systematically increase with time, may randomly increase in connection with one or more subsequent gaming events (e.g., slot game reel spins), may systematically increase in connection with one or more subsequent gaming events (e.g., increase every gaming event, or every other gaming event, etc.), or the like. This increased modifier 312 may increase by a single value (e.g., a 3× multiplier increasing to a 4× multiplier), multiple values (e.g., a 3× multiplier increasing to a 5× multiplier), randomly, etc.

Game play 304 may continue for any number of additional gaming events while the modifier is suspended 310 and possibly increasing 312. For example, further gaming events associated with playing the game 304 may include some number of intermediate gaming events creating respective game results, such as game result-B 314, game result-C 316, etc. The modifier use may be suspended 310 and potentially grow in size and/or value for any length of time, any number of gaming events (e.g., any number of spins in a slot game), etc. In some embodiments, the range of gaming events or time in which the modifier is stored for potential growth is limited, such as, for example, between three and ten spins in a slot game or poker game, etc.

One embodiment allows the player to choose when to use the stored/suspended modifier. For example, the player may be enabled to choose a particular spin in a slot game in which to use the suspended modifier before the spin has begun, or at least before the spin has completed. In other embodiments, the player may be allowed to choose the suspended modifier at any time, even after a gaming event has completed (e.g., after a spin has populated a slot grid with symbols). In one embodiment, the player may be able to choose when to use a stored/suspended modifier after some other time or event(s) has occurred, such as any time after the modifier has been indicated to have stopped growing, or any time within some number of gaming events (e.g., any time between spin number four and spin number ten in a slot game), etc. In other embodiments, the gaming event to which the suspended modifier will be applied is randomly selected, although in other embodiments it may be a set number of gaming events, or associated with or triggered by some gaming event (e.g., symbol combination, sub-symbol, etc. in base game), etc. In the representative embodiment of FIG. 3, the increased modifier 312 is applied 318 to a randomly selected one of the game results, depicted as game result-N 320 in FIG. 3.

Therefore, while the modifier is suspended 310, in one embodiment it will increase at least somewhat relative to its initial state, although might not increase on every gaming event (e.g., reel spin in slot game), or might even decrease in some instances. For purposes of this example, it is assumed that the modifier increased during its suspension 310, such as changing from a first lower multiplier to a second higher multiplier. This higher multiplier is then applied 318 to the randomly selected game result-N 320. The player thereby risked the use of the initially-awarded modifier that could have been applied to the game result-A 306, by choosing 302 to suspend 310 use of the modifier until a randomly selected game result-N 320. In return for taking this risk, the player may potentially get a higher result, such as if the game result-N 320 as enhanced by the increased modifier 312 is greater than the game result-A 306 as modified by the originally-awarded modifier 300.

Figure 4:
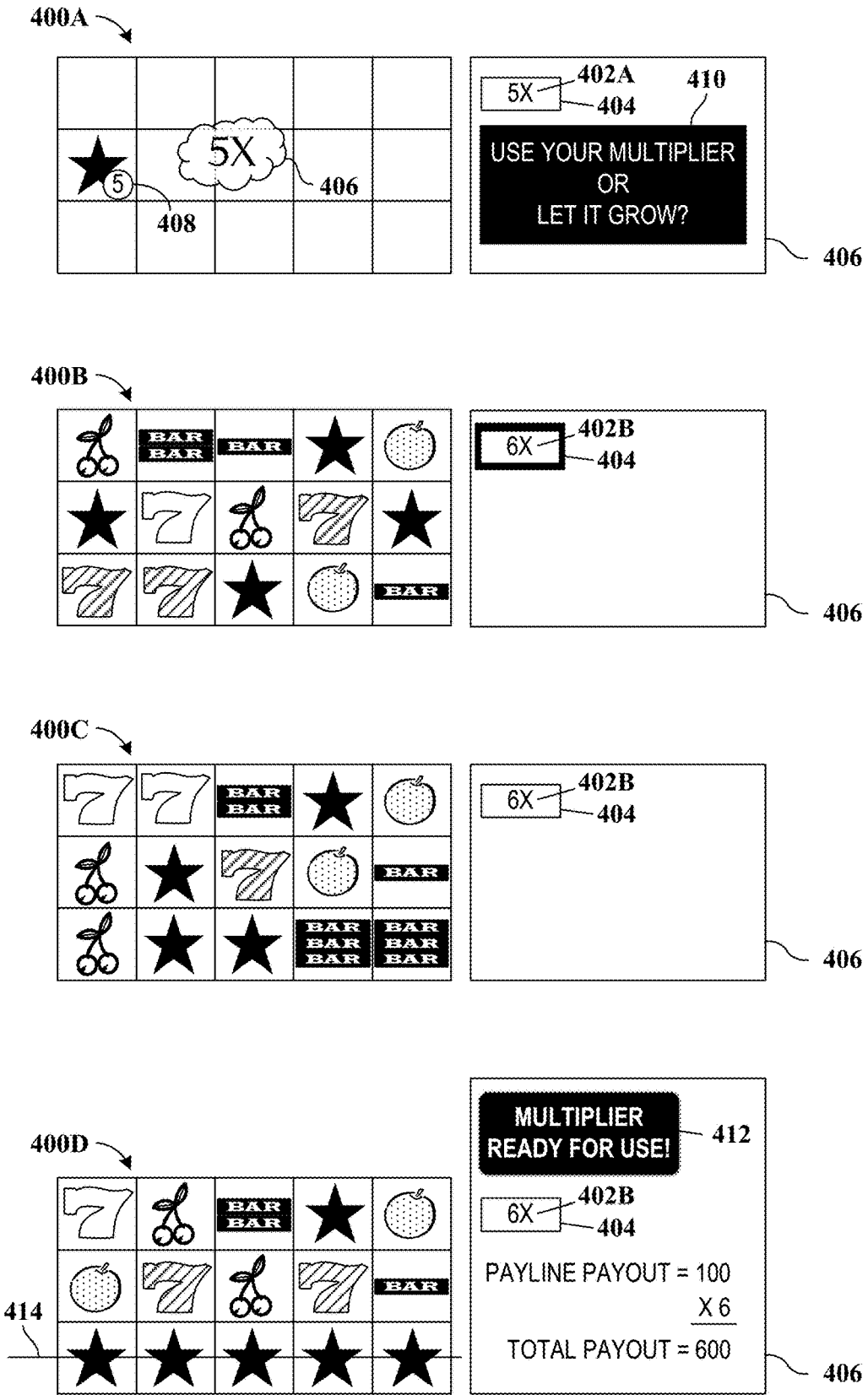
FIG. 4 illustrates a representative slot game enabling a player to choose to either currently use, or postpone use of, one or more payout modifiers.

FIG. 4 illustrates a representative slot game enabling a player to choose to currently use or postpone use of one or more payout modifiers. This embodiment depicts a representative progression of slot game grids on which modifier enhancement features as described herein are presented. Initial grid 400A is depicted before slot game symbols have come to rest in the grid 400A. At least one modifier, which is a multiplier in this example, is presented before or during a spin that results in symbol placement as depicted at slot grid 400B. In other embodiments, the grid may be populated with symbols before the player's decision is made to use or defer use of an awarded modifier(s).

In the slot game embodiment of FIG. 4, at least one multiplier is randomly presented to the player before the symbols have completely populated the grid 400A. The initially-awarded multiplier 402A may be presented to the user in any desired manner, such as audibly and/or visually, such as via an off-grid display window 404 that may be presented on a display 406, or in any on-grid manner such as via an overlay 406, sub-symbol 408, bonus event where the random multipliers are awarded and usable over a number of subsequent events (e.g., for X free spins), etc.

In accordance with one embodiment, the player is presented with an opportunity to keep and presently use the multiplier 402A that was provided, or set it aside for future use. In the embodiment of FIG. 4, a visual notification 410 is provided to the player to provide notification of this choice, which can be provided anywhere, including a primary or auxiliary display 406. By way of any user input, the player can make a choice. In one embodiment where the grid 400A is not yet populated with symbols, the player is allowed to choose to keep the awarded multiplier to be applied to the results of the next spin (i.e. gaming event), knowing there may or may not be a payout on that spin. In another embodiment where the grid 400A is not yet populated with symbols, the player is allowed to choose to keep the awarded multiplier to be applied to the results of the next win. In still another embodiment, the grid 400A may already be populated with symbols as a result of the spin completing, whereby the player is allowed to choose to use the awarded multiplier to a win on that spin or to postpone using it. Thus, if the player could see that the result of the spin was a payline win of 20 credits, and it was known that a 5× (five times) multiplier was awarded, the player could make an informed decision to surrender the awarded 100 credits (20 credits×5) for a chance to have the multiplier (or increased multiplier) apply to a payout (perhaps increased payout) at a later time. In this manner, the player can risk a current enhanced award for a chance to obtain a more favorable award at a subsequent point during play of the game.

In one embodiment, if the player chooses to postpone use of the awarded multiplier (e.g., 5× multiplier 402A), game play continues while the awarded multiplier is set aside for future use, and in some embodiments grows, or in still other embodiments at least has the potential to grow. Slot game grid 400B depicts the results of a reel spin that "could" be the target of the modifier that has been held in abeyance. For example, the particular reel spin to which the stored modifier applies may be randomly determined, such that it could occur in connection with any ensuing reel spin. In this example, grid 400B is not randomly selected as the result to which multiplier 402B will be applied. Therefore, the multiplier 402B remains in abeyance until a further spin(s).

As noted by the 6× (six times) multiplier 402B, it has increased from the 5× (five times) multiplier 402A that it was at a previous stage. This is due to the increase of the modifier(s), a multiplier(s) 402B in this example, while it is being held. In one embodiment, the player is not allowed to apply the multiplier 402B while it is in this growth or incubation stage, and is allowed to apply it when randomly notified that it will be or can be used. In this example, it can be seen that the 5× multiplier 402A increased to a 6× multiplier 402B in connection with at least one subsequent reel spin resulting in the symbol population shown via grid 400B. In some embodiments, the stored multiplier 402B will be used on the very next spin result, and therefore would apply to a winning payout (if any) from grid 400B. In still other embodiments, the player may be allowed to utilize the stored multiplier 402B at any stage after choosing to postpone its use. In the present example, another embodiment is assumed, where the player is allowed to utilize the stored multiplier when randomly determined by the game.

Grid 400C depicts another subsequent symbol population following a reel spin. As seen in this example, the 6× multiplier 402B did not randomly increment. In some embodiments, incrementation of the multiplier 402B occurs randomly, if at all. In other embodiments, incrementation of the multiplier 402B occurs on each subsequent spin, until it can be applied to a gaming event result. In any event, incrementation can be sequential (e.g., by a value of one; 5× to 6× to 7×, etc.), or may be incremented by any random amount (e.g., 3× to 5× to 9×, etc.) or fixed amount (e.g., increase by two each time, or increase based on a pattern, etc.). In this example, a reel spin result provided via grid 400C was not selected to have the multiplier 402B applied thereto, nor did the multiplier 402B increase in connection with this reel spin.

Grid 400D depicts yet another result of a reel spin, where this real spin was randomly selected to apply the growing multiplier 402B. Notification of this may be provided in any desired manner, such as providing some visual indicator 412. In one embodiment, the notification may indicate that the multiplier is ready for use for the next win, or for the current or next spin, etc. In an embodiment where the multiplier 402B would be available for the spin result shown via grid 400D, it is possible that there is no win in which to apply the multiplier 402B, which would highlight a risk faced by the player when choosing to postpone use of the multiplier. In an embodiment where the multiplier 402B is used for the next win (versus just the next spin), the multiplier 402B would be applied to one or more winning paylines arising on the grid 400D. In one embodiment, the multiplier 402B may be applied to only one win, such as a particular payline win, scatter pay, etc. In another embodiment, the multiplier 402B may be applied to multiple wins obtained via the grid 400D, and in still other embodiments the multiplier 402B is applied to all wins obtained via the grid 400 D.

In the embodiment of FIG. 4, one matching symbol combination (five star symbols) on payline 414 will be enhanced by the multiplier 402B. For example, assuming a payline payout of 100 credits, the total payout with a 6× multiplier would be 600 credits, which may be presented via the display 406 and/or may be reflected in the player's credit bank.

More than one modifier (e.g., multiplier in a slot game) may be awarded and suspended (with possible growth) at a time. As long as multipliers are randomly awarded, and have not yet been selected by or made available to the player to apply to a payout, stored multipliers can accumulate. With multiple modifiers concurrently stored for later use, it is possible that more than one such modifier will be selected at the same time to apply to a gaming payout. In such case, each of the multiple modifiers may be individually applied to the payout(s), or alternatively the concurrent activation of more than one stored multiplier may create an enhanced modification to the payout(s). For example, if a 3× and 5× multiplier are activated from the suspended multiplier repository, the multipliers could be added (e.g., 8× in this example), multiplied (e.g., 15× in this example), used in back-to-back gaming events (e.g., reel spins) versus individually applied to the same payout, etc. Therefore, game rules can further enhance modifiers in any desired fashion when multiple suspended modifiers become active at the same time or within some window of time or events.

Figure 5A:
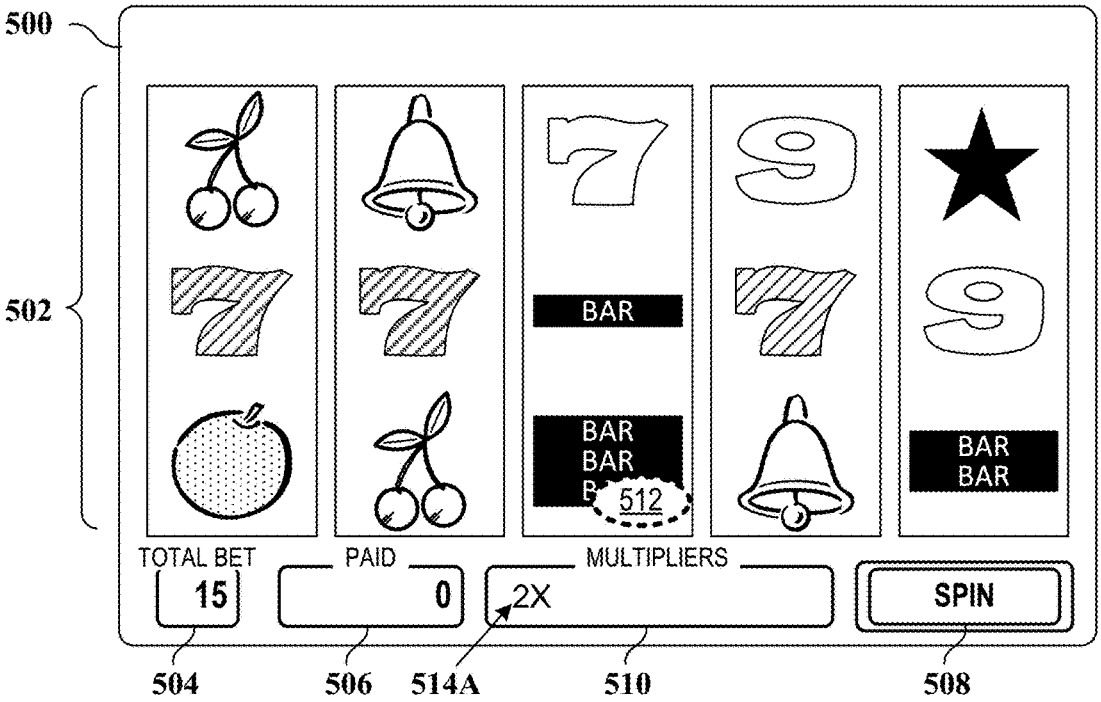
FIGS. 5A-5I are diagrams of a gaming display showing a representative game sequence that uses stored modifiers for future gaming events according to the disclosure

FIGS. 5A-5I are diagrams of a gaming display showing a representative game sequence that uses stored modifiers for future gaming events according to the disclosure. FIG. 5A depicts a gaming display 500 includes a game grid 502 having, for example, five game reels each having multiple game symbols. A player interface portion of the display 500 may include meters, interactive buttons and the like, such as such as total bet meter 504, paid meter 506 showing payouts, spin button 508 to at least initiate a reel spin, and a multiplier (and/or other modifier) display 510 to present multipliers awarded and potentially increased as described herein.

FIG. 5A shows the game grid 502 after a reel spin. Symbols are shown to populate the various reels of the game grid 502. In this embodiment, a multiplier 514A is randomly awarded in connection with a reel spin. While the multipliers that are awarded may be any value, in one embodiment the initial value is within some range (e.g., 2× to 5×). The multiplier may be randomly awarded in any desired manner, such as the use of a sub-symbol 512. The sub-symbol may identify the value of the modifier, such as depicting a 2× (two times) multiplier on its face, or may merely be an indication where the value of the multiplier is then displayed in the multiplier display 510. In the example of FIG. 5A, the sub-symbol 512 causes a 2× multiplier 514 to be provided to the player and presented in the multiplier display 510. It should be recognized that more than one sub-symbol, and consequently multiplier, may be provided in a single spin in some embodiments. Further, the sub-symbols may be different for each of the different starting multiplier values, or may be the same, may be provided anywhere on the grid 500A or alternatively only with a certain symbol(s), etc.

As described in connections with FIGS. 3 and 4, some embodiments involve a player selection to presently use the awarded modifier, or to stow it for future use. In the embodiment of FIGS. 5A-5I, no such choice is involved, but rather multipliers are randomly awarded and randomly made available for use at future times, with potential multiplier growth involved. Thus, in one embodiment, the player may not have a choice to apply the multiplier to the current reel spin, but rather the multiplier is presented and then automatically set aside for potential multiplier growth and later use. In another embodiment, the presented multiplier is not applied to the current spin, and the player is provided with the option of using the multiplier for the next spin or the next win. Or, the player may choose to defer use of the multiplier for use in the spin or win that follows the multiplier being revealed from the oven.

Figure 5B:
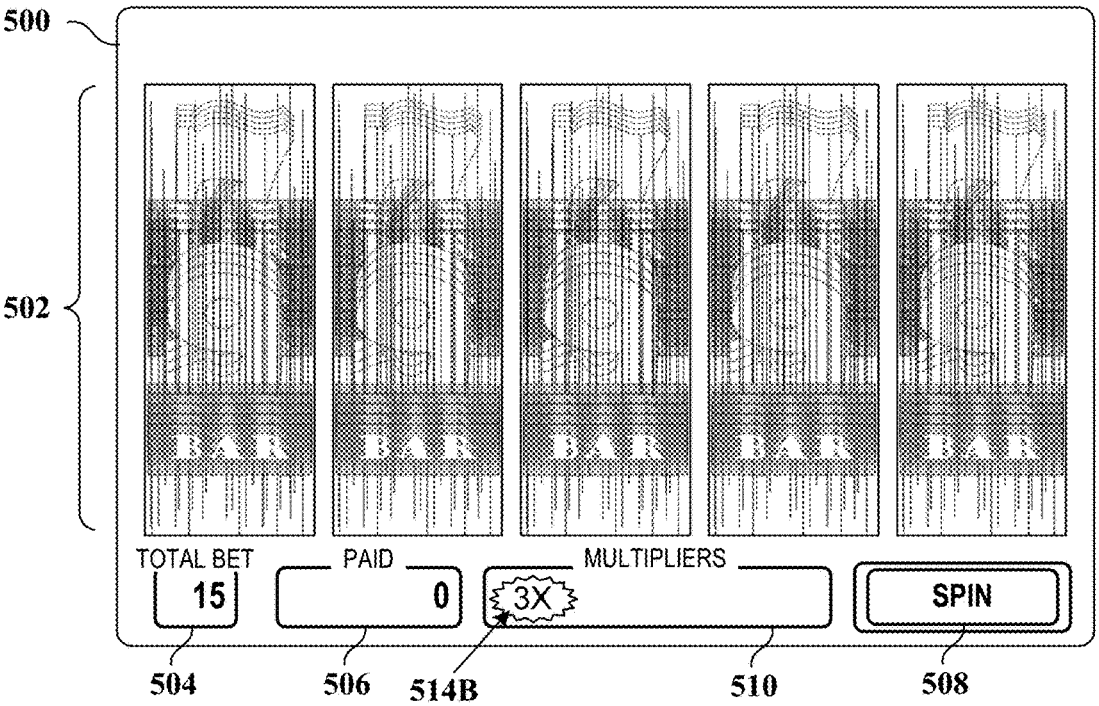

FIG. 5B depicts a subsequent spin, where the 2× multiplier 514A in the multiplier display 510 has been increased to a 3× multiplier 514B. This increase may occur with or without some announcement or fanfare, and in some embodiments the manner of announcing the increase may correlate to the theme of the game (e.g., a bakery theme may indicate the buns are rising; a magician theme may indicate that magic caused the multiplier to increase, etc.).

Figure 5C:
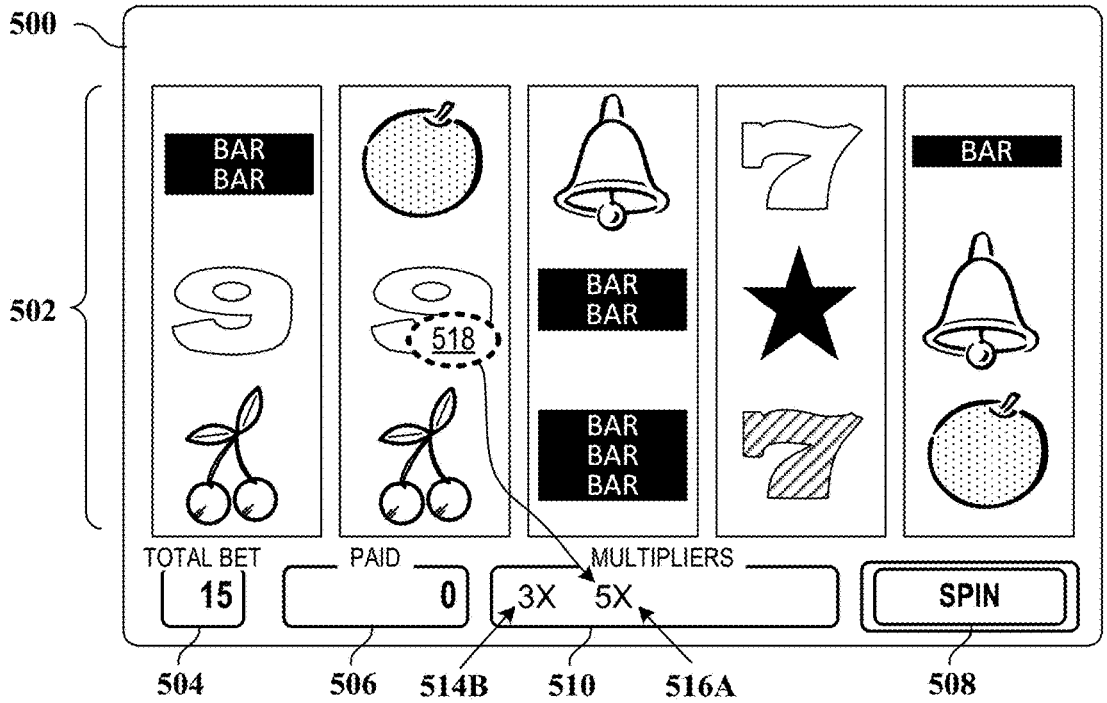
Figure 5D:
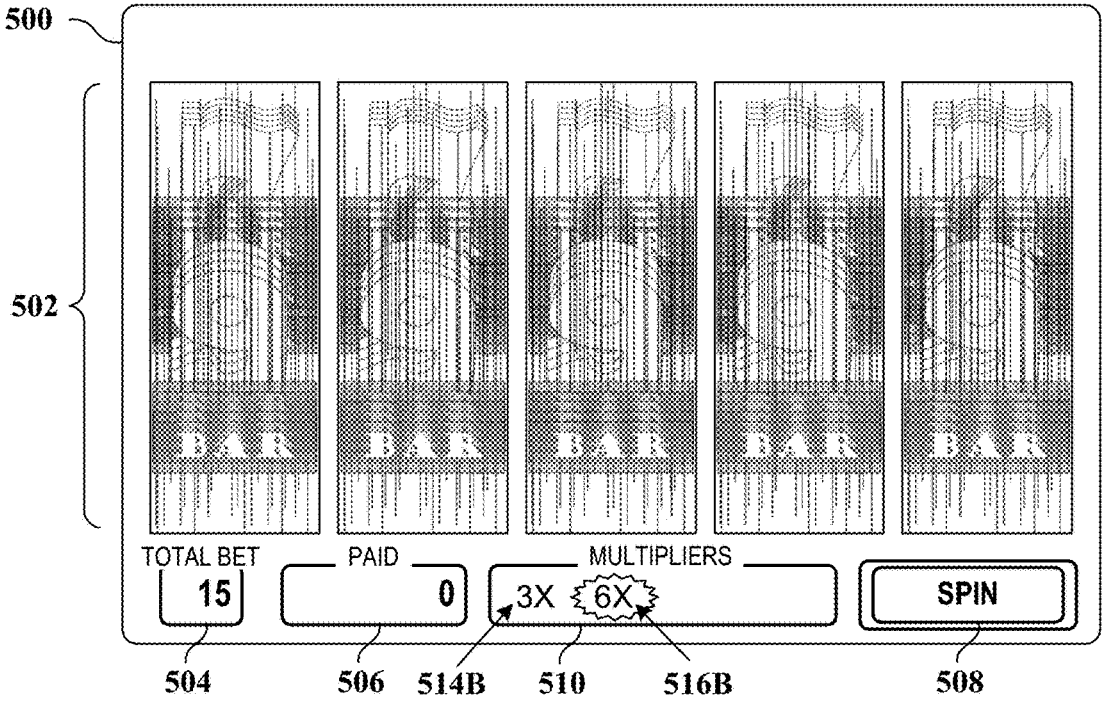

FIG. 5C depicts a representative next spin result in the game play sequence, where yet another multiplier 516A is randomly awarded, such as by way of sub-symbol 518. In this embodiment, the awarded multiplier 516A is a 5× multiplier, which is displayed in the multiplier display 510. Therefore, in this example, the player has to awarded multipliers 514B, 516A, which may be activated for use on one or more future spins. FIG. 5D depicts a subsequent spin, where the 5× multiplier 516A in the multiplier display 510 has been randomly increased to a 6× multiplier 516B. As can be seen in this example, both of the original 2× and 5× multipliers 514A, 516A have randomly increased to 3× and 6× multipliers 514B, 516B.

Figure 5E:
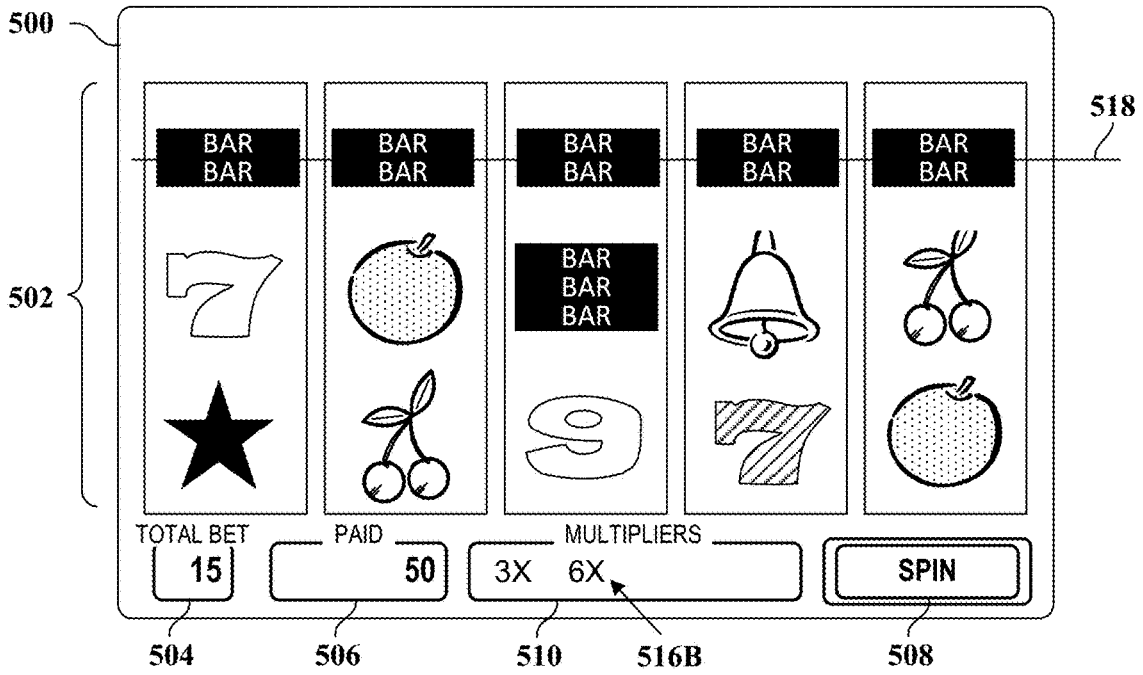

FIG. 5E shows a further spin in the gaming sequence, where a symbol combination along payline 518 provides a 50-credit award as depicted via the paid meter 506. However, neither of the stored multipliers 514B, 516B were identified for current use, and therefore neither of the stored multipliers 514B, 516B are used to enhance or otherwise modify the 50-credit payout.

Figure 5F:
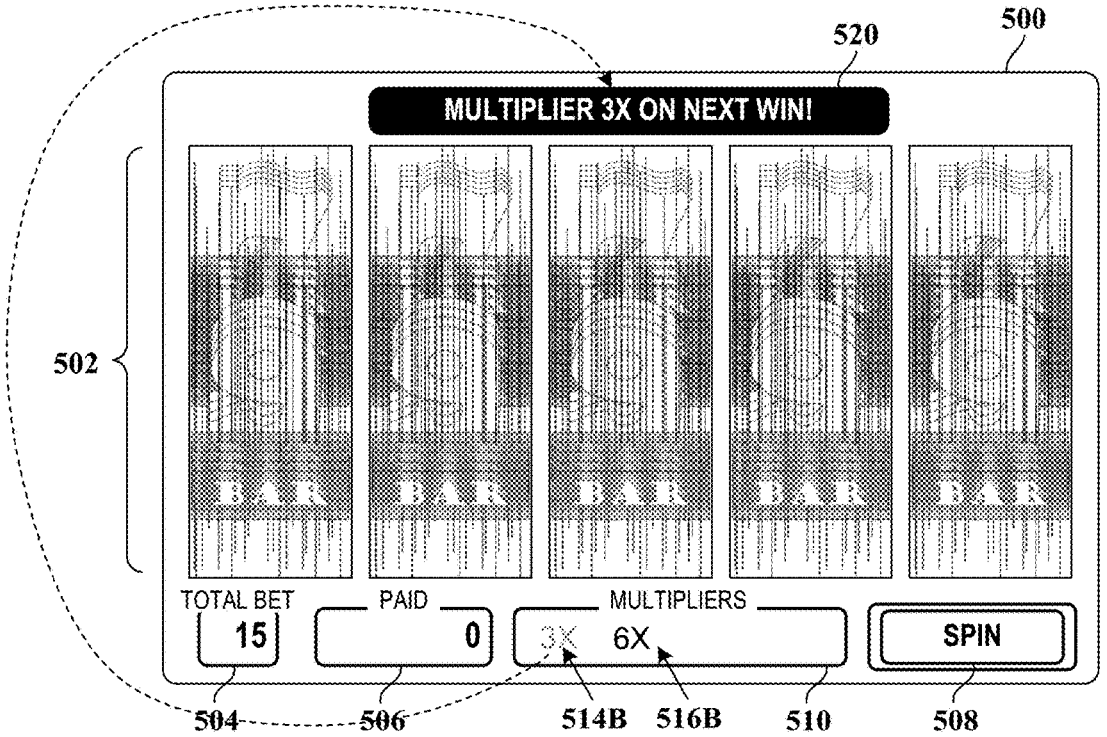
Figure 5G:
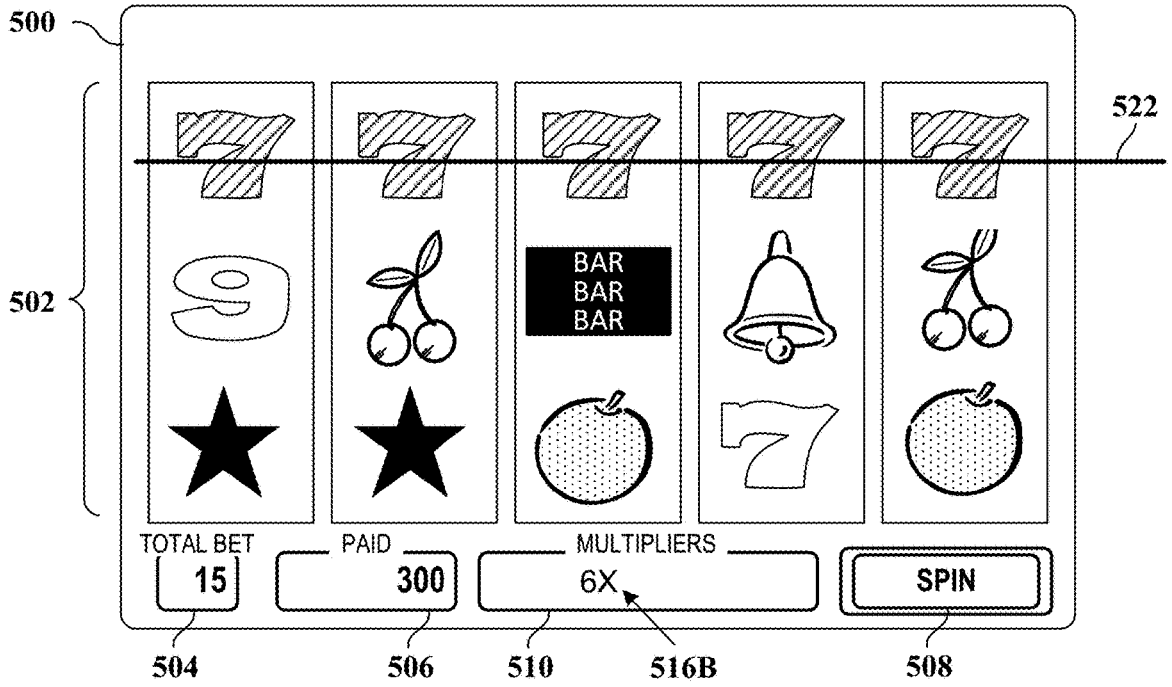

FIG. 5F depicts a next spin in the gaming sequence, where it is randomly determined that the 3× multiplier 514B is to be used on the next winning payout. This fact may be presented to the player in any desired fashion, including but not limited to removing the multiplier 514B from the multiplier display 510, and creating a new notification 520 to inform the player that the 3× multiplier 514B will be used on the next win (although other embodiments could apply it elsewhere, such as on the next spin, win or lose). FIG. 5G depicts the result of that spin (or one or more subsequent spins), where a symbol combination along payline 522 provides a 100-credit award (for example). Because the 3× multiplier 514B had been randomly activated for the next win, the 100-credit award is multiplied by three for a total award of 300 credits, as depicted via the paid meter 506.

Figure 5H:
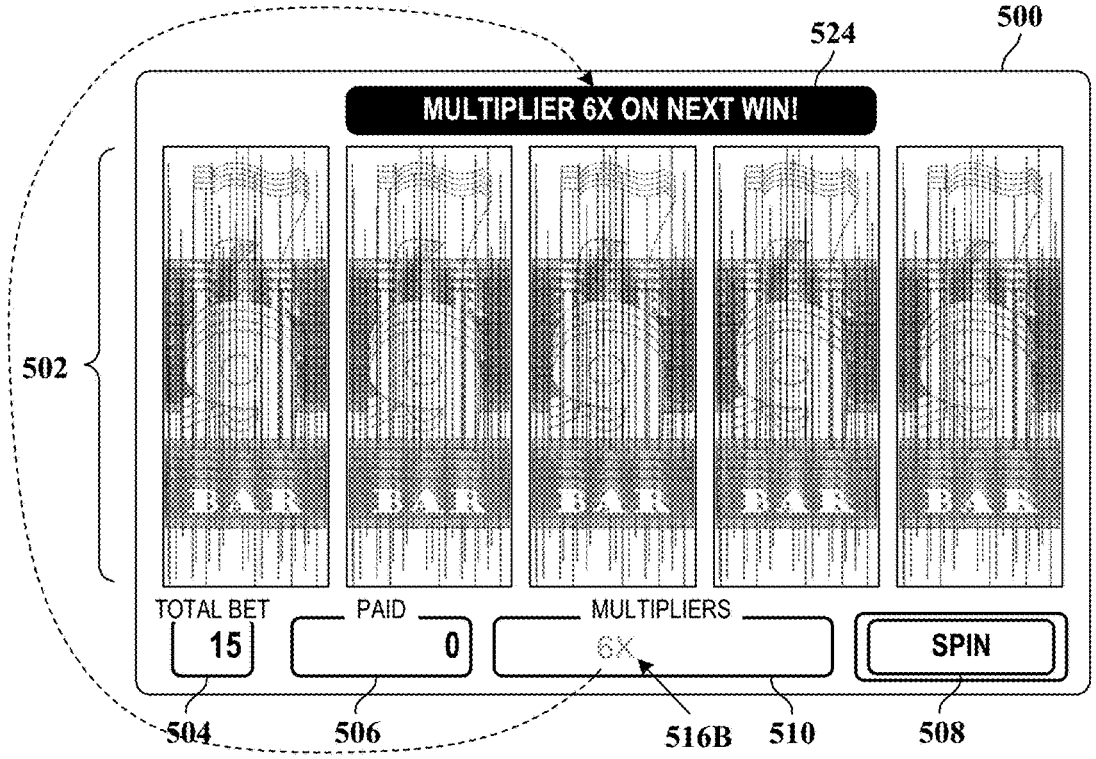
Figure 5I:
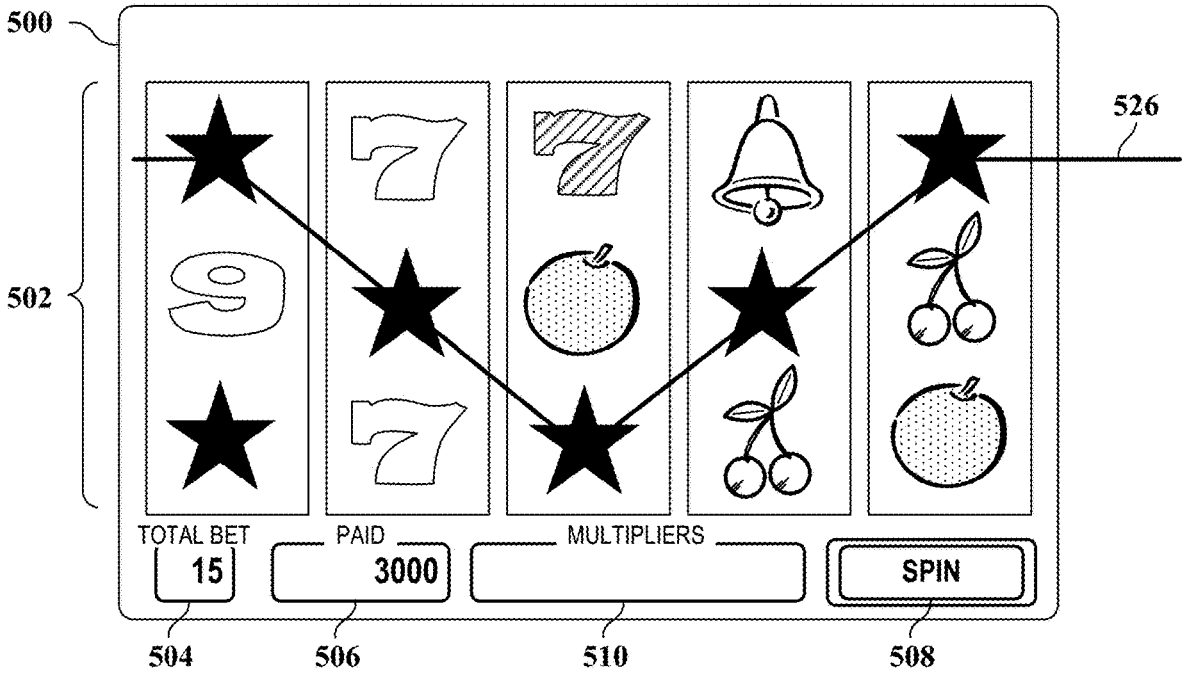

FIG. 5H depicts a next spin in the gaming sequence, where it is randomly determined that the 6× multiplier 516B is to be used on the next winning payout. Again, this may be presented to the player in any desired fashion, such as removing the multiplier 516B from the multiplier display 510, and creating a new notification 524 to inform the player that the 6× multiplier 516B will be used on the next win. FIG. 5I depicts the result of that spin (or one or more subsequent spins), where a symbol combination along payline 526 provides a 500-credit award (for example). Because the 6× multiplier 516B had been randomly activated for the next win, the 500-credit award is multiplied by six for a total award of 3000 credits, as depicted via the paid meter 506.

It should be noted that in the example of FIGS. 5A-5I, one or more additional multipliers may have been awarded, and further increases of one or more of the multipliers may have occurred before being applied to a payout. Therefore, FIGS. 5A-5I represent just one example to facilitate an understanding of a representative manner in which multipliers may be awarded, increased, and applied to respective winning payouts.

In one embodiment, the principles described herein are applied to other awards rather than modifier values. For example, the principles described herein may be applied to credit awards, whether randomly generated or obtained in connection with a gaming result such as a payline win(s), scatter pay win(s), etc. For example, in one embodiment, the player may be awarded 100 credits in a slot game, and is presented with an opportunity to keep the award or to store it for later acceptance after a potential rise in value. For example, particular awards may be made available for such storage and potential increase in value, or perhaps all awards could be available for such storage and potential increase in value. In one embodiment, there may be a risk associated therewith, such as the possibility of the granted award going down in value. In such an embodiment, the player risks a known, awarded credit value to allow it the potential to grow in value, with the knowledge that it could in fact decrease in value. The player could choose to take the stored award at any time during its potential increase/decrease, or in other embodiments the increased or decreased credit award is given back to the player at a random time (which includes being awarded in connection with some other random event, such as the occurrence of a special symbol, sub-symbol, payline win, scatter pay, etc.).

These features described herein can be used in connection with any game of chance, including slot games, poker games, keno, roulette, bingo, and the like. They may be provided using physical structures, or electronic structures created in computing hardware and displayed as virtual structures of such physical structures. The gaming events described herein may be provided as a base game of chance or an auxiliary gaming event such as a bonus event, free spin event, or other secondary event.

Figure 6A:
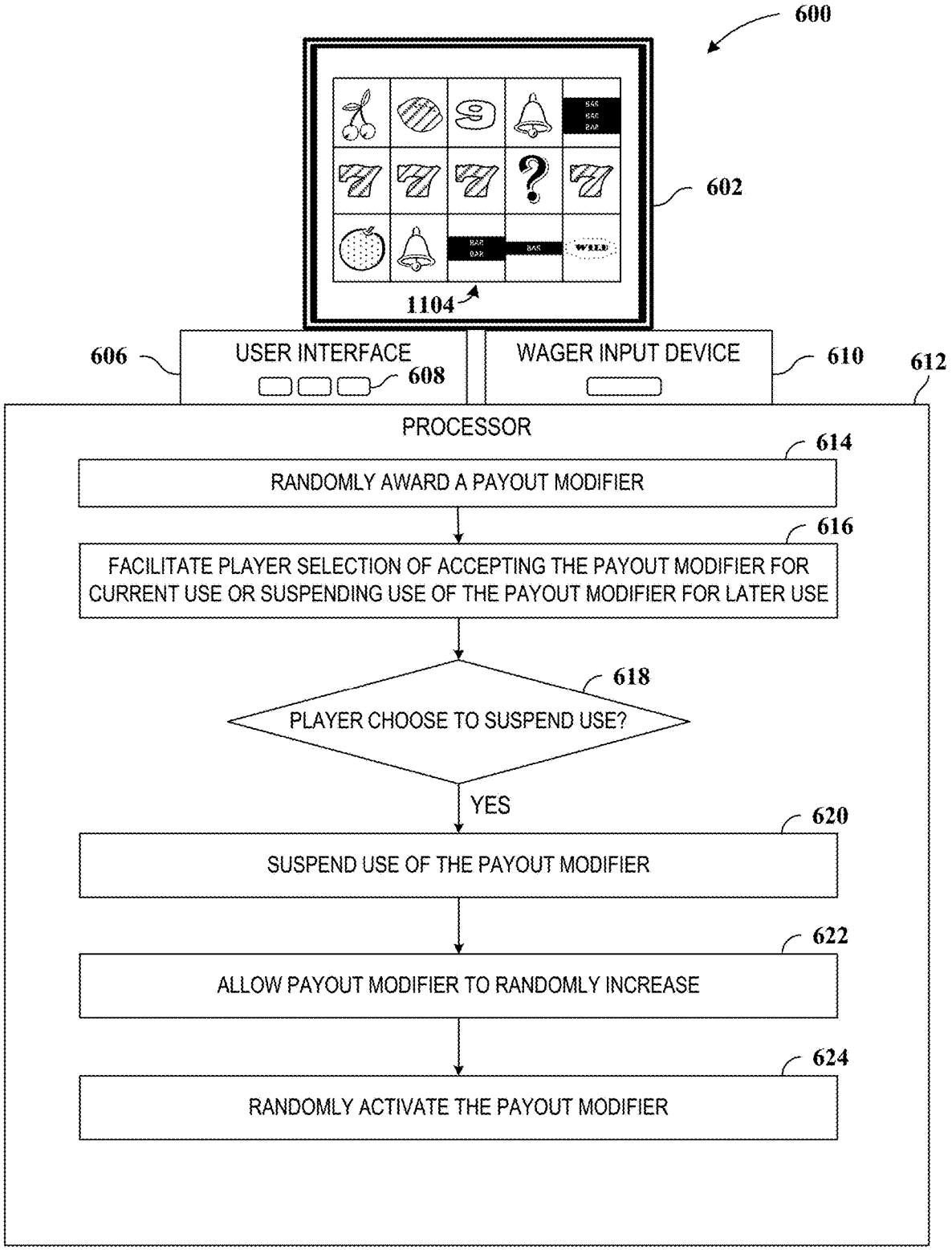
FIGS. 6A and 6B are block diagrams of representative alternative slot game apparatuses for enhancing payout modifiers during their deferred use.

FIG. 6A is a block diagram of a representative slot game apparatus for enhancing payout modifiers during their deferred use. In this embodiment, a slot game device 600 is provided on which players can play slot games. The representative slot game device 600 includes at least a display 602 presenting a slot game symbol array or "grid" 604 of symbol locations, a user interface 606 including at least one user input 608 to enable a player to initiate a slot game event presented via the slot game grid 604, and a wager input device 610 structured to identify and validate player assets and ultimately permit the player to play the slot game event when the player assets are provided. The slot game device 600 also includes a processor 612 configured to randomly award 614 a payout modifier, and facilitate 616 player selection to either accept the payout modifier for current use or suspend it for later use. If the player chooses to suspend use of the payout modifier until a later time as determined at decision block 618, the processor 612 is further configured to allow the payout modifier to randomly increase, and the payout modifier is at some point randomly activated to be applied to a payout to create a modifier-enhanced payout.

The slot game device 600 configures the processor 612 (which may include one or more cooperative processing devices) to structurally program functional elements into hardware modules. Processor 612 circuitry configuration thus changes based on the modules developed by software to carry out the desired methodology. For example, the processor 612 is programmed by software/code to create a hardware-based module to randomly award 614 a payout modifier, and to create other such software/code modules for each of the operations 614-624.

Figure 6B:
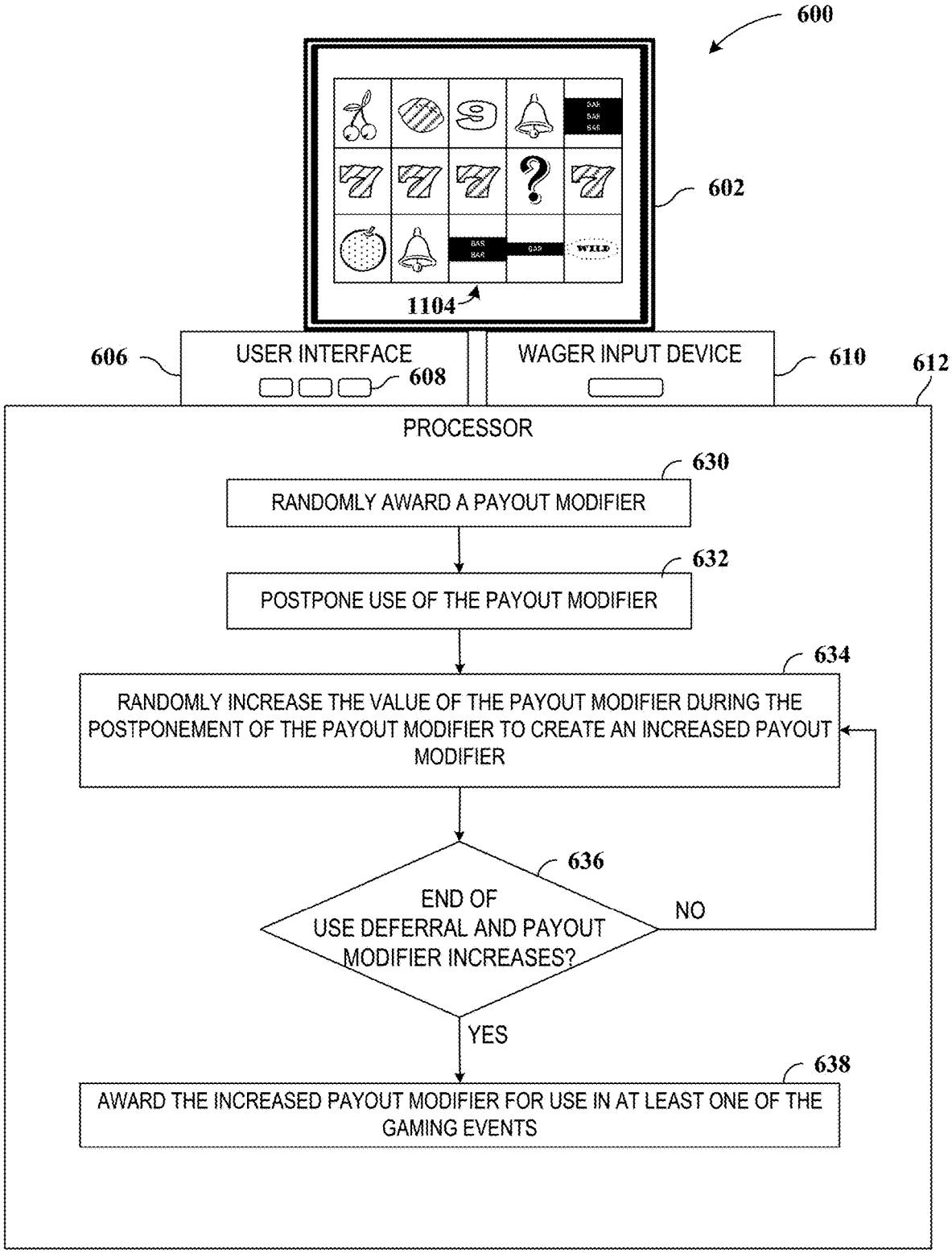

Other structural modules may be created on the slot game device using a properly configured processor 612. Referring now to the example of FIG. 6B, the processor 612 may be configured into programmed modules to randomly award 630 a payout modifier, postpone 632 the use of the payout modifier, randomly increase 634 the value of the payout modifier during its postponement to create an increased payout modifier, randomly determine 636 whether it is the end of the postponement of use and payout modifier increases, and if so, to award 638 the increased payout modifier for use in at least one of the gaming events.

In alternative embodiments, the player could select which future payout to apply the increased modifier to, such as being able to apply it to any payout in the next five gaming events (e.g., next five reel spins), or to any of the next three payouts, etc.

Figure 7A:
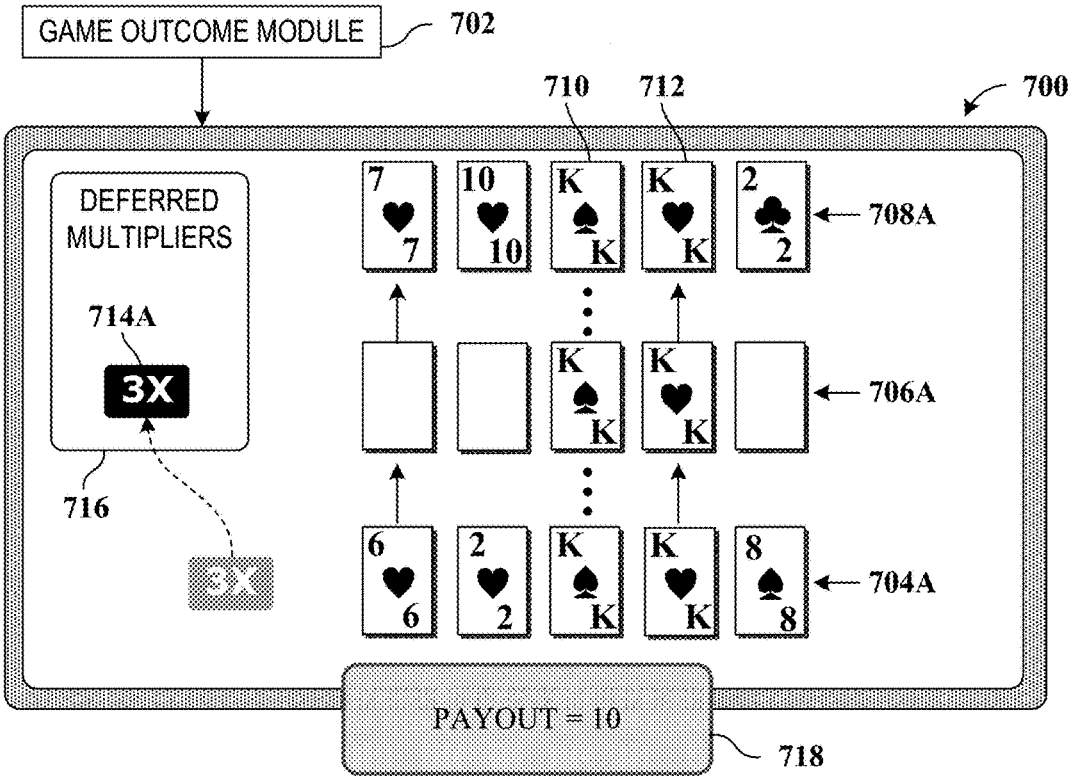
FIGS. 7A and 7B illustrate a poker game embodiment that allows deferral of payout modifiers and increasing the value of the payout modifiers during their deferral.
Figure 7B:
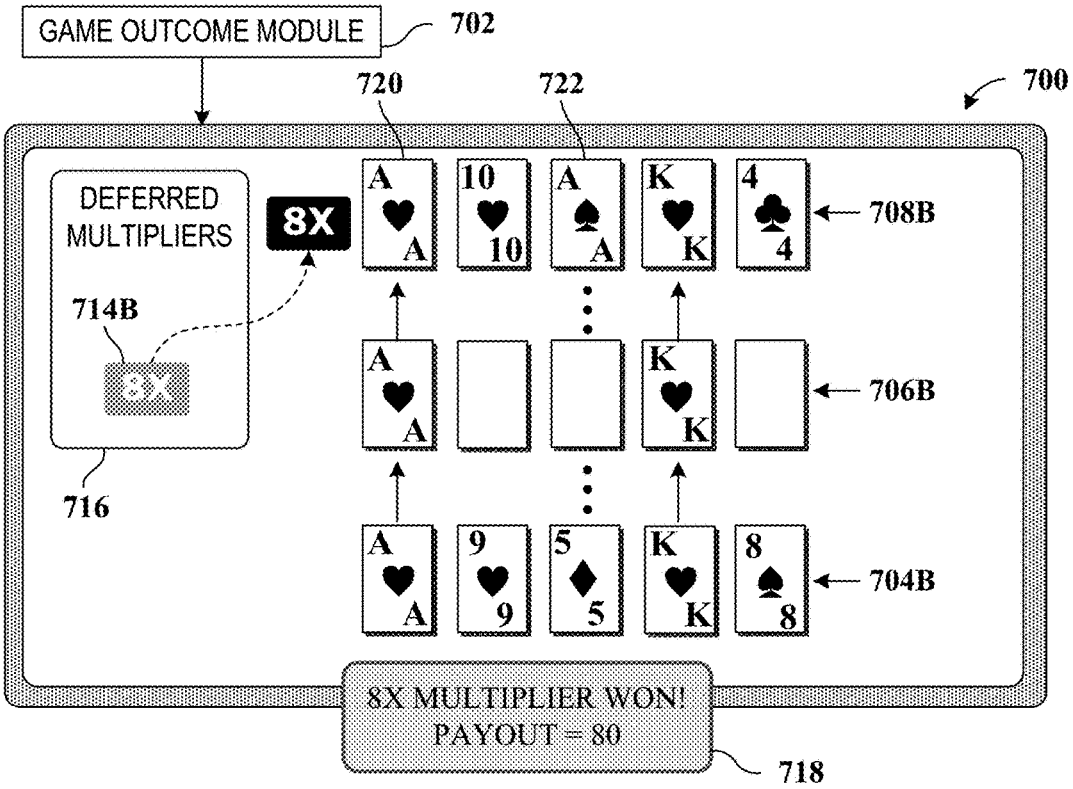

FIGS. 7A and 7B illustrate another representative embodiment of a game that allows deferral of payout modifiers and increasing the value of the payout modifiers during their deferral. FIG. 7A depicts a representative draw poker game presented on a gaming display 700. The game outcome module 702 may represent the software-programmed or otherwise configured hardware to specify a given one or more game combination results, such as poker hands, stud poker hands, hold-em poker hands, or any other card game hands. The game outcome module 702 may include the game probability configuration parameters such as the number of card decks, the number of each card in each deck, and/or other indicia on the cards. These variables provide a natural probability of occurrence of any of the game combination results associated with that card/gaming event. The game outcome module 702 also represents the game combination generation and determination functions which generates one or more card hands, and selects the original cards/hands, any replacement cards/hands (e.g., draw cards), etc. to produce game outcomes.

In the example of FIG. 7A, an original hand 704A is dealt, that by chance includes a Six of Hearts (6-H), Two of Hearts (2-H), King of Spades (K-S), King of Hearts (K-H), and Eight of Spades (8-S). As this example is a draw poker embodiment, the player is allowed to retain or "hold" one or more cards of the original hand 704A. In this example, the player holds the K-S and K-H and discards the rest as depicted at intermediate hand 706A. When the discarded cards are replaced to provide a final hand 708A, the best payout available for the cards of the final hand 708A are a pair of kings, including the K-S 710 and the K-H 712, which is assumed to pay ten (10) credits in this example, as may be presented via a display window 718 or elsewhere.

The player may be randomly provided with a payout modifier (e.g., multiplier, other mathematical or fixed value increaser, etc.). In this example, a three-times (3×) multiplier 714A is provided in connection with any of the hands 704A, 706A, 708A during play. The multiplier 714A may be provided anywhere on the display area (including in the deferred multipliers area 716), and is set aside in the deferred multipliers area 716 until available to use on a subsequent hand(s). As can be seen, the payout multiplier 714A was not available for use with the winning pair of kings (710, 712) that provided a 10-credit payout, but rather was stored for later use, with a known impending increase in its value in some embodiments, or at least the chance of an increase in its value in other embodiments.

FIG. 7B depicts a subsequent hand, when the deferred multiplier has been activated for use. As seen, the original 3× multiplier 714A in deferred multipliers area 716 has grown to an 8× multiplier 714B while it has been set aside and unavailable to the player. The player was dealt an original hand 704B, held cards and disposed of others as shown at hand 706B, and obtained a final hand 708B that includes a pair of aces, namely an Ace of Hearts (A-H) 720 and Ace of Spaces (A-S) 722. Assume that normally a pair of aces provides a 10-credit payout. Here, since the increased multiplier 714B has been activated and is now available, the 10-credit payout is increased by eight times, for a total of 80 credits, as depicted via the display window 718. FIGS. 7A and 7B depict an example using a single hand in draw poker, but the principles are equally applicable to multi-hand poker or any other poker game where a plurality of final hands are available for payouts.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

What is claimed is:

1. A video poker game apparatus for enhancing gaming awards in a gaming activity including a series of poker gaming events, comprising:

a display presenting a plurality of virtual card locations forming a poker hand;

a user interface including at least one user input to enable a player to initiate a poker game event presented via the poker hand;

a wager input device structured to identify and validate player assets, and to permit the player to play the poker game event when the player assets are provided; and a processor configured to:

randomly award a payout modifier;

facilitate player choice of accepting the payout modifier for current use or suspending use of the payout modifier for later use;

in response to the player choice to suspend use of the payout modifier for later use, suspend use of the payout modifier, and allow the payout modifier to randomly increase; and randomly activate the payout modifier to be applied to a payout to create a modifier-enhanced payout.

2. The video poker game apparatus of claim 1, wherein the processor is configured to allow the payout modifier to randomly increase by causing the payout modifier to increase at least some amount to create an increased modifier, and to randomly activate the payout modifier by randomly activating the increased modifier to be applied to the payout to create the modifier-enhanced payout.

3. The video poker game apparatus of claim 2, wherein the processor is configured to cause the payout modifier to increase at random times while the use of the payout modifier is suspended.

4. The video poker game apparatus of claim 2, wherein the processor is configured to cause the payout modifier to increase by random amounts while the use of the payout modifier is suspended.

5. The video poker game apparatus of claim 2, wherein the processor is configured to cause the payout modifier to increase each time another of the poker gaming events is played and while the use of the payout modifier is suspended.

6. The video poker game apparatus of claim 1, wherein the processor is configured to allow the payout modifier to remain at a same value without increasing in value.

7. The video poker game apparatus of claim 1, wherein the processor is further configured to prohibit use of the payout modifier while the payout modifier is suspended, and wherein the processor is configured to randomly activate the payout modifier to be applied to the next payout occurring in connection with the poker gaming events.

8. The video poker game apparatus of claim 1, wherein the processor is further configured to prohibit use of the payout modifier while the payout modifier is suspended, and wherein the processor is configured to randomly activate the payout modifier to be applied to the payout, if any, of the next one of the poker gaming events.

9. The video poker game apparatus of claim 1, wherein the processor is configured to suspend the use of the payout modifier and allow the payout modifier to randomly increase for a random number of the poker gaming events.

10. The video poker game apparatus of claim 1, wherein the processor is configured to suspend the use of the payout modifier and allow the payout modifier to randomly increase for a number of the gaming events within a predetermined range of the poker gaming events.

11. The video poker game apparatus of claim 1, wherein the processor is configured to randomly award the payout modifier before a result of one of the poker gaming events to which the player could accept the payout modifier for current use.

12. The video poker game apparatus of claim 1, wherein the processor is configured to randomly award the payout modifier after a result of one of the poker gaming events to which the player could accept the payout modifier for current use, whereby the player is aware of both the payout modifier and any payout associated with the result of the one of the poker gaming events.

13. The video poker game apparatus of claim 1, wherein the processor is configured to:

randomly award a plurality of payout modifiers; and randomly activate one or more the payout modifiers to be applied to the payout.

14. The video poker game apparatus of claim 13, wherein the processor is configured to concurrently activate a plurality of the payout modifiers, and create a new payout modifier using a mathematical association of the plurality of the payout modifiers.

15. A video poker game apparatus for enhancing gaming awards in a poker game activity including a series of poker game events, comprising:

a display presenting a plurality of virtual card locations forming a poker hand;

a user interface including at least one user input to enable a player to initiate a poker game event presented via the poker hand;

a wager input device structured to identify and validate player assets, and to permit the player to play the poker game event when the player assets are provided; and a processor configured to:

randomly award a payout modifier in connection with any one of the poker game events;

postpone use of the payout modifier over one or more additional ones of the poker game events;

randomly increase a value of the payout modifier during the postponed use of the payout modifier to create an increased payout modifier; and randomly determine an end of the postponed use and the random increase in value of the payout modifier, and in response, award the increased payout modifier for use in at least one of the poker game events.

16. The video poker game apparatus of claim 15, wherein the processor is configured to award the increased payout modifier for use in the next one of the poker game events.

17. The video poker game apparatus of claim 15, wherein the processor is configured to award the increased payout modifier for use in the next one of the poker game events having a winning payout.

18. The video poker game apparatus of claim 15, wherein:

randomly awarding a payout modifier comprises randomly awarding a first payout modifier; and the processor is further configured to:

randomly award at least a second payout modifier during the postponed use of the first payout modifier;

postpone use of both the first and second payout modifiers;

randomly increase respective values of the first and second payout modifiers during the postponed use of both the first and second payout modifiers;

randomly determine an end of the postponed use and the random increase in value of each of the first and second payout modifiers to respectively create an increased first payout modifier and an increased second payout modifier; and award the increased first payout modifier in response to determining the end of the postponed use of the first payout modifier, and award the increased second payout modifier in response to determining the end of the postponed use of the second payout modifier.

19. The video poker game apparatus of claim 15, wherein the processor is configured to randomly award a plurality of additional payout modifiers.

20. The video poker game apparatus of claim 15, wherein the processor is further configured to facilitate player choice of accepting the payout modifier for current use, or to postpone use of the payout modifier for later use.

* * * * *